US006739699B1

(12) United States Patent
Sender et al.

(10) Patent No.: US 6,739,699 B1
(45) Date of Patent: May 25, 2004

(54) METHOD FOR ASSESSING COLOR PERFORMANCE IN A PRINTING DEVICE

(75) Inventors: Jordi Sender, Barcelona (ES); Eduardo Amela, Barcelona (ES); Juan Saez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/453,554

(22) Filed: Jun. 4, 2003

(51) Int. Cl.[7] ..... B41J 2/21; B41J 29/393
(52) U.S. Cl. ..... 347/43; 347/19
(58) Field of Search ..... 347/43, 15, 14, 347/19

(56) References Cited

U.S. PATENT DOCUMENTS 6,598,953 B2 * 7/2003 Bland ..... 347/19

* cited by examiner

*Primary Examiner*—Lamson D Nguyen
(74) *Attorney, Agent, or Firm*—Foley & Lardner LLP

(57) ABSTRACT

A method for assessing color performance in a printing device, which is provided with color printing means for printing at least three primary color inks, comprises the steps of:

(a) providing a printing file for printing at least one color scale, said scale comprising:
- a plurality of colored regions defined by substantially equal amounts of a first primary color ink and of a second primary color ink and a variable amount of a third primary color ink, said amount of third primary color ink increasing progressively from each region to the adjacent region in one direction of the scale, and
- a transition region defined by substantially equal amounts of the three primary color inks;

(b) printing said printing file with said printing device to obtain a printed color scale; and (c) visually analysing the printed color scale to assess the performance of said color printing means for printing said third primary color ink, on the basis of the position of the transition region along the color scale.

20 Claims, 2 Drawing Sheets

METHOD FOR ASSESSING COLOR PERFORMANCE IN A PRINTING DEVICE

The present invention relates to a method for assessing color performance in a printing device.

In a printing apparatus, for example an inkjet printer, there is the need to assess the accuracy of the colors printed by the device. For instance, a user may have the perception that the printed colors are not consistent from time to time, or that some colors do not correspond to their intended subject, for example skin tones or corporate colors; it may also happen that grey tones are not neutral but are biased towards a particular color. Thus, the printing device may have errors in its color performance.

However, the cause for color errors is not always a failure or malfunctioning of the printing device. Colors may be modified by the printer settings, for example if some ink emulations are selected; and even applications external to the printing device, such as image processing software, may also influence the colors which are printed in the printing device.

Therefore, when dealing with color issues it is necessary to assess if any trouble with the printed colors is caused by the printing device itself.

In case it is determined that indeed the color performance of the printing device is not correct, it is also desirable to ascertain which of the color channels is causing the trouble, and to quantify the error in order to solve the problem.

Some traditional methods for assessing color performance involve printing a test or demo sheet and compare it to an external color reference; however, especially in case of remote troubleshooting, an external reference is not always available, and has a number of drawbacks. Sophisticated tools such as spectrophotometers are costly and are not suitable for normal technical support work; Pantone color tables and similar references may fade with time and are not always at hand.

On the other hand, in many cases it would be useful to verify if there is a malfunctioning of the printing device remotely, without the need for on-site technical support visits; this is difficult to achieve while relying on an external reference.

U.S. Pat. No. 6,215,562 and U.S. Pat. No. 5,604,567 disclose methods for visual calibration of a color printer based on iterative processes.

U.S. Pat. No. 5,604,567 describes a process in which a test pattern with a plurality of color patches is printed and the most grey patch of the test pattern is visually selected for performing color correction; after a first correction, the test pattern is printed again and the process is repeated as many times as necessary. This method avoid the use of sophisticated tools; however, the selection of the most grey patch may not be easy and introduces a degree of uncertainty in the method; furthermore, it requires several printing and correcting steps.

Embodiments of the present invention provide a method for assessing color performance in a printing device in a fast and reliable way. Further embodiments of the invention ameliorate other drawbacks mentioned in the prior art.

According to an aspect of the present invention, a method for assessing color performance in a printing device, which is provided with color printing means for printing at least three primary color inks, comprises the steps of:

(a) providing a printing file for printing at least one color scale, said scale comprising:

a plurality of colored regions defined by substantially equal amounts of a first primary color ink and of a second primary color ink and a variable amount of a third primary color ink, said amount of third primary color ink increasing progressively from each region to the adjacent region in one direction of the scale, and a transition region defined by substantially equal amounts of the three primary color inks;

(b) printing said printing file with said printing device to obtain a printed color scale; and (c) visually analysing the printed color scale to assess the performance of said color printing means for printing said third primary color ink, on the basis of the position of the transition region along the color scale.

The method allows to assess easily the performance of the printing device ; this is due to the fact that with a scale defined according to the invention, the visual identification of the transition region is possible without the need for an external reference. Furthermore, in case of malfunctioning of the color printing means, the method allows to quantify the error and thus perform the required correction.

The existence of an error and its quantification are decided in a single operation, i. e. printing and visually analysing the color scale once.

The printing and analysis of the color scale can be performed on-site by technical support staff or simply by the user, without the need for a visit of the support staff.

In embodiments of the invent ion, said printing file contains an independent color scale for each of said primary color inks, and said step (c) comprises visually analysing the printed color scales to assess the performance of said color printing means for printing each of the three primary color inks, on the basis of the position of the transition region along each color scale.

By this method, the performances of the three primary color inks can be verified and quantified in the same operation, simply printing and analysing the printing file.

According to some embodiments, said scale has a number of regions between 5 and 20.

Optionally, a numerical scale is printed along said color scale, such as to make it easier to check if the transition region is in the foreseen position and to quantify any error.

Said printing file may further provide a dark region defined by large predetermined amounts of each of the three primary color inks, said dark region being arranged such that it is printed prior to said color scale.

Printing these dark regions enhances the color accuracy of the scale, because it helps to avoid small errors due to heat-up of the pen.

According to embodiments of the invention, said printing file further provides a grey background defined by a predetermined amount of black ink, against which said color scale is printed.

This neutral grey background reduces the contrast with the color scales; it has been found that this makes the visual evaluation of the transition region easier than when a white background is used, especially if the file is printed on glossy printing media.

In embodiments of the invention, said primary color inks comprise Cyan, Magenta and Yellow.

The printing file may include a TIF image file with said color scale.

According to some embodiments, the printing file further comprises predetermined settings for the printing device.

The predetermined settings may include disabling any ink emulation or color rendering that may alter the colors defined in the printing file.

These features help to avoid errors when printing the color scales, such as wrong settings inputted by the user that may modify the printed colors.

According to some embodiments, said printing file is included in the machine code of the printing device, and preferably it is such that it cannot b e modified by a user, such that any alteration of the colors set in the printing file is avoided.

The printing device may be an inkjet printer, and said color printing means may be inkjet printheads.

According to another aspect, the present invention relates to a method for assessing color performance in a printing device provided with color printing means for printing at least three primary color inks, wherein said method comprises the steps of:

(a) providing a printing file for printing at least three independent color scales, one associated to each primary color ink, each scale comprising:
  - a plurality of colored regions defined by a variable amount of one primary color ink associated to the scale, the amount of said one primary color ink increasing progressively from each region to the adjacent region in one direction of the scale, and equal amounts of two other primary color inks, and
  - a transition region defined by substantially equal amounts of the three primary color inks;

(b) printing said printing file with said printing device to obtain the printed color scales; and (c) visually analysing each printed color scale to assess the performance of said color printing means for printing each primary color ink, on the basis of the position of the transition region along each color scale.

According to a further aspect the invention relates to a method for color calibrating a printing device provided with color printing means for printing at least three primary color inks, wherein said method comprises the steps of:

(a) providing a printing file for printing at least one color scale, said scale comprising:
  - a plurality of colored regions defined by substantially equal amounts of a first primary color ink and of a second primary color ink and a variable amount of a third primary color ink, said amount of third primary color ink increasing progressively from each region to the adjacent region in one direction of the scale, and
  - a transition region defined by substantially equal amounts of the three primary color inks;

(b) printing said printing file with said printing device to obtain a printed color scale; and (c) visually analysing the printed color scale to assess the performance of said color printing means for printing said third primary color ink, on the basis of the position of the transition region along the color scale; and (d) color calibrating said color printing means for printing said third primary color ink in the printing device, according to the performance assessment of step (c).

In embodiments of this method, said printing file contains an independent color scale for each of said primary color inks, said step (c) comprises visually analysing the printed color scales to assess the performance of said color printing means for printing each of the three primary color inks, on the basis of the position of the transition region along each color scale, and said step (d) comprises color calibrating said color printing means for printing each primary color ink in the printing device, according to the performance assessment of step (c).

Yet another aspect of the present invention relates to a printing file containing at least one color scale, said scale comprising:

- a plurality of colored regions defined by substantially equal amounts of a first primary color ink and of a second primary color ink, and a variable amount of a third primary color ink, said amount of third primary color ink increasing progressively from each region to the adjacent region in one direction of the scale, and
  - a transition region defined by substantially equal amounts of the three primary color inks.

The printing file may be used in methods according to the invention, for assessing the color performance of a printing device in a fast and simple way.

Said printing file may further comprise a grey background defined by a predetermined amount of black ink, against which said color scale is printed.

In embodiments of the invention, the printing file further comprises predetermined settings for a printing device.

According to another aspect, the present invention relates to an inkjet printer provided with printheads for at least three primary color inks and comprising a printing file as described above.

A particular embodiment of the present invention will be described in the following, only by way of non-limiting example, with reference to the appended drawings, in which.

The present invention provides a method for assessing color performance in a printing device.

Color printing devices use a set o f at least three so-called primary colors which, mixed in suitable proportions, can reproduce almost any other color.

An inkjet printer, for instance, usually comprises a printhead for ejecting black ink (K) and at least three more printheads, each ejecting droplets of ink of one primary color, usually cyan (C), magenta (M) and yellow (Y). These colors are normally referred to as subtractive primary inks. For printing a desired color, the printer ejects a certain amount of ink from each of the color printheads.

To each primary color may be associated a complementary color, which is obtained in each case with equal amounts of the other two primary colors only; for example, the complementary color associated to cyan is red, which is obtained with equal proportions of magenta and yellow.

The method according to the invention is based on the fact that for evaluation of greys and for identifying a transition between two complementary colors there is no need for an external reference: it is quite reliable to visually ascertain which element of a color scale ranging from a primary color to its complementary color represents the transition between the two different colors, i.e. the element of the scale which is impossible to assign to one or to the other color.

The method makes use of a printing file, which may be included in the machine code of the printing device or alternatively can be provided to the user when necessary, which contains an independent color scale for each of three primary colors, in this case cyan (C), magenta (M) and yellow (Y) , which are the primary color inks most commonly used in an inkjet printing device.

Figure 1:
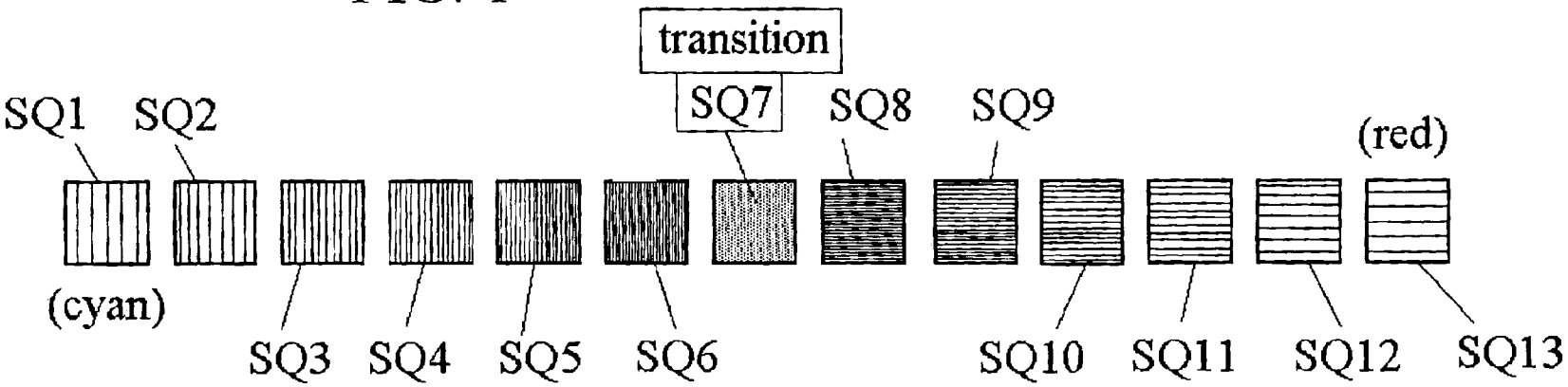
FIG. 1 shows an embodiment of a color scale used in the method of the present invention.

FIG. 1 shows one such color scale, in this case for cyan. The color scale is made up by colored regions, which in this example are shaped as separate squares SQ1, SQ2, SQ3. . . SQ13arranged side by side. The scale is configured as follows.

In the printing file, to each colored square is associated a certain amount of the three primary color inks C,M,Y, as shown in Table 1.

TABLE 1

| SQUARE | CYAN | MAGENTA | YELLOW | INTENDED VISUAL COLOR |
|---|---|---|---|---|
| SQ1 | 90/100 | 60/100 | 60/100 | cyanish |
| SQ2 | 85/100 | 60/100 | 60/100 | ↓ |
| SQ3 | 80/100 | 60/100 | 60/100 | |
| SQ4 | 75/100 | 60/100 | 60/100 | |
| SQ5 | 70/100 | 60/100 | 60/100 | |
| SQ6 | 65/100 | 60/100 | 60/100 | |
| SQ7 | 60/100 | 60/100 | 60/100 | transition (grey) |
| SQ8 | 55/100 | 60/100 | 60/100 | ↓ |
| SQ9 | 50/100 | 60/100 | 60/100 | |
| SQ10 | 45/100 | 60/100 | 60/100 | |
| SQ11 | 40/100 | 60/100 | 60/100 | |
| SQ12 | 35/100 | 60/100 | 60/100 | |
| SQ13 | 30/100 | 60/100 | 60/100 | reddish |

The amounts of ink are indicated as proportions of the maximum amount that can be provided by the pens or printheads of the printing device.

Table 1 shows that all the squares of the cyan (C) scale have assigned an equal amount of magenta ink and yellow ink, in this example 60/100; and each square has assigned a variable amount of cyan ink, this amount decreasing progressively from one square to the next, the central square SQ7 of the scale having assigned the same amount of cyan, magenta and yellow ink.

With the values of table 1, square SQ1 at one end of the scale is intended to be cyanish in color; the central square SQ7 is intended to be a transition region, which in this case is neutral grey in color; and square SQ13 at the opposite end of the scale is intended to be reddish, since red is the complementary color to cyan.

The intermediate squares from SQ2 to SQ6 will progressively lose cyan and become increasingly greyish, but maintaining a cyanish aspect, and those from SQ8 to SQ12 will range from a slightly red-tinted grey towards a more intense reddish color.

In the figure, cyanish squares SQ1 to SQ6 have been represented by vertical lines, and reddish squares SQ8 to SQ13 by horizontal lines; in both cases, squares with a higher density of lines are increasingly more grey.

It has to be pointed out that in the figures of the present specification the colors at the ends of the scales have been identified in a simplified way as cyan, red, magenta, etc. even if the proportion of primary colors in the table makes it clear that the colors will not be pure.

The color scale for magenta will be configured like in Table 1, but with the amount of magenta being variable and those of cyan and yellow being constant; in this case, the scale will range from magentish to neutral grey and to greenish; the same applies to yellow, the color scale in this case ranging from yellowish to neutral grey and to bluish.

If a printing file with this color scales is printed in a printing device that is working correctly as far as the color is concerned, the printout will show three color scales each with a neutral grey transition square in the central position SQ7, as in FIG. 1.

However, if the printing device has a problem in one of the color channels, the printout will reflect the error and the transition square in the scale corresponding to that color will be displaced, as explained in the following by means of a particular example.

In the example, it is assumed that the cyan printhead has an error and yields a higher drop volume of 10/100 more than intended.

Due to this malfunctioning, while following the instructions on the printing file, the device will in fact deposit 10/100 more cyan ink in each square than established in the printing file; in the case of the cyan color scale, the amounts of deposited ink are those shown in Table 2.

TABLE 2

| SQUARE | CYAN | MAGENTA | YELLOW | PRINTED COLOR |
|---|---|---|---|---|
| SQ1 | 90/100 + 10/100 | 60/100 | 60/100 | cyanish |
| SQ2 | 85/100 + 10/100 | 60/100 | 60/100 | ↓ |
| SQ3 | 80/100 + 10/100 | 60/100 | 60/100 | |
| SQ4 | 75/100 + 10/100 | 60/100 | 60/100 | |
| SQ5 | 70/100 + 10/100 | 60/100 | 60/100 | |
| SQ6 | 65/100 + 10/100 | 60/100 | 60/100 | |
| SQ7 | 60/100 + 10/100 | 60/100 | 60/100 | |
| SQ8 | 55/100 + 10/100 | 60/100 | 60/100 | |
| SQ9 | 50/100 + 10/100 | 60/100 | 60/100 | transition (grey) |
| SQ10 | 45/100 + 10/100 | 60/100 | 60/100 | ↓ |
| SQ11 | 40/100 + 10/100 | 60/100 | 60/100 | |
| SQ12 | 35/1GO + 10/100 | 60/100 | 60/100 | |
| SQ13 | 30/100 + 10/100 | 60/100 | 60/100 | reddish |

Figure 2:
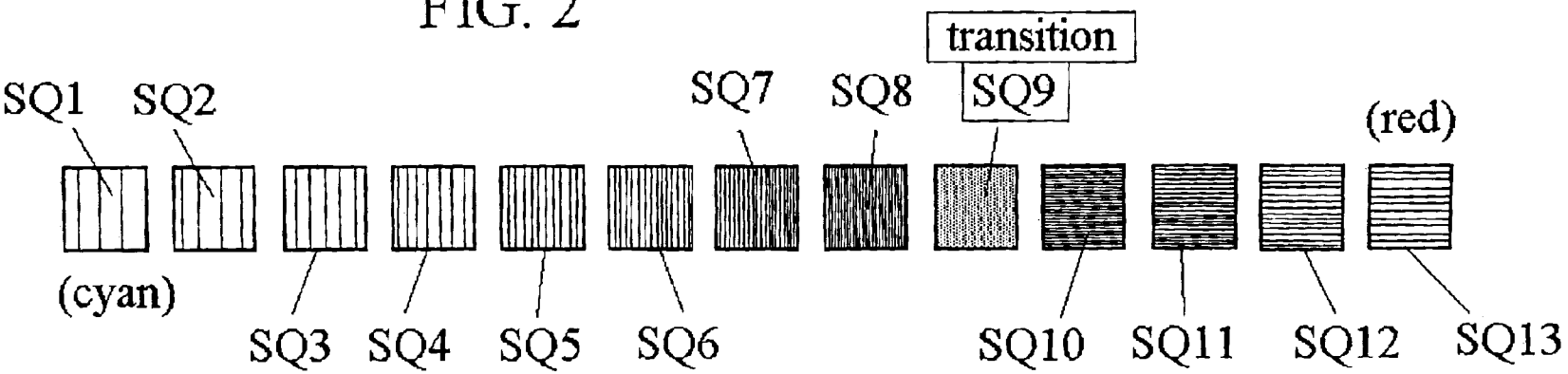
FIG. 2 shows a color scale printed in a printing device that has a malfunction in the color deposition.

As can be deduced from Table 2, the visible consequence on the printed cyan color scale is that the transition square, given by an equal proportion 60/100 of the three primary color inks, is not the center square SQ7 but another square SQ9, displaced towards one end of the scale. This situation is illustrated in FIG. 2, which represents the cyan scale printed by the misfunctioning device of this example. The transition square, in this particular example, will still be grey in color because it has equal amounts of the three primary inks.

Since in every case the transition will be only in one square, and the adjacent ones will be clearly tinted either with a color or with its complementary, it is easy and reliable to visually identify if the transition square is in the center of the scale or not.

In the same example, and also due to the malfunctioning of the cyan printhead, the color scales for magenta and yellow will also vary with respect to their intended appearance.

Table 3 shows the amounts of ink actually printed in each square for the magenta scale, and the resulting printed colors.

TABLE 3

| SQUARE | CYAN | MAGENTA | YELLOW | PRINTED COLOR |
|---|---|---|---|---|
| SQ1 | 60/100 + 10/100 | 90/100 | 60/100 | magentish |
| SQ2 | 60/100 + 10/100 | 85/100 | 60/100 | ↓ |
| SQ3 | 60/100 + 10/100 | 80/100 | 60/100 | |
| SQ4 | 60/100 + 10/100 | 75/100 | 60/100 | |
| SQ5 | 60/100 + 10/100 | 70/100 | 60/100 | |
| SQ6 | 60/100 + 10/100 | 65/100 | 60/100 | |
| SQ7 | 60/100 + 10/100 | 60/100 | 60/100 | transition |
| SQ8 | 60/100 + 10/100 | 55/100 | 60/100 | ↓ |
| SQ9 | 60/100 + 10/100 | 50/100 | 60/100 | |
| SQ10 | 60/100 + 10/100 | 45/100 | 60/100 | |
| SQ11 | 60/100 + 10/100 | 40/100 | 60/100 | |
| SQ12 | 60/100 + 10/100 | 35/100 | 60/100 | |
| SQ13 | 60/100 + 10/100 | 30/100 | 60/100 | greenish |

As can be deduced from the table, the transition square that will not have neither a magentish neither a greenish aspect will be SQ7, in the center of the scale, thus indicating that the magenta printhead is working correctly. In this case, due to the error in the cyan printhead, the transition square will not be neutral grey in color, because it has a larger proportion of cyan than of magenta and yellow, but it will still be easy and reliable to identify it visually as the transition between the two complementary colors, magenta and green.

If the three color printheads are malfunctioning, the transition squares of the three color scales will not be centered along the scale, and they will not be neutral grey in color.

Consequently, a method for assessing the color performance of a printing device can be carried out simply by:

(a) providing a printing file having color scales as described, (b) printing said file in a printing device that needs to be verified, and (c) visually analysing the resulting printed color scales, determining if each color is performing correctly or not on the basis of the position of the transition region along the color scale. This transition square may be grey or not, depending on the performance of the three colors, as explained above.

By analysing the printed scales it is possible to assess if the printing device is making an error in one or more of the primary colors C,M,Y; furthermore, a quantification of the error for each malfunctioning color can be made, the error being given by the shift in the position of the transition square along the color scale.

Once the error has been visually assessed, it is possible to perform a correction of the printing means by any suitable method, e.g. using a control panel of the printing device; the method described is thus also suitable for calibrating the printing device by adding a color calibration step in which the corrections are performed.

The visual analysis can be carried out by technical support staff, but also by a user that can inform a technical support centre of the result.

Figure 3:
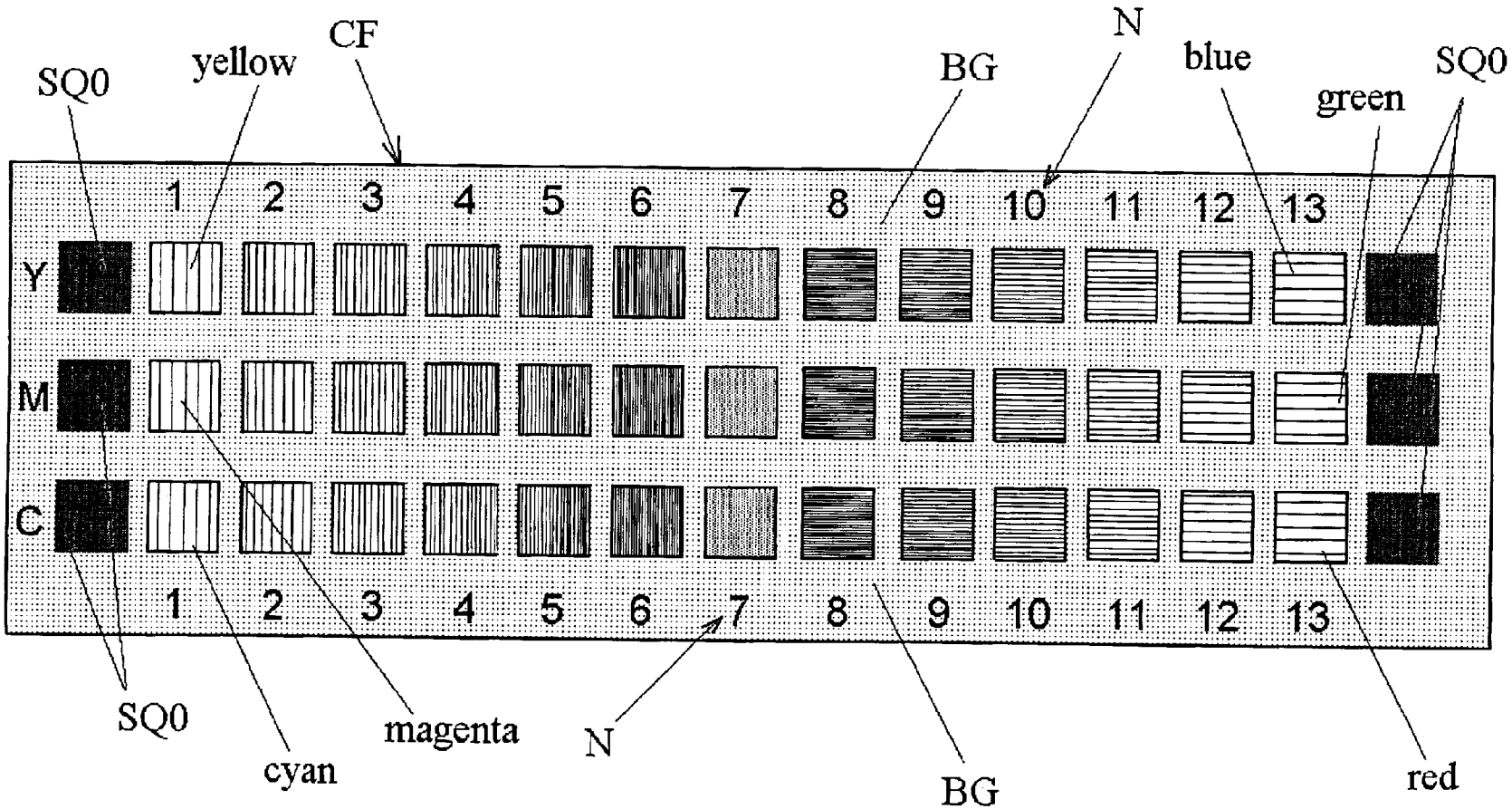
FIG. 3 shows an embodiment of a color file with a color scale for each primary color ink.

FIG. 3 shows the print ed color file CF according to an embodiment of the invention, with a color scale for each primary color C,M,Y and further features that will be described in the following.

As shown in the figure, the file includes numerical scales N which are printed at the top and bottom of the color scales, such as to make it easier to quantify any possible error.

Furthermore, the file provides dark squares SQ0 at the beginning and at the end of each color scale, which are defined by a large amount, such as 100/100, of th e three color inks C,M,Y. These squares SQ0 are printed before and after each color scale, and guarantee that from the start of the color scale printing operation all the pens are heated up and will not introduce a color distorsion in the scale itself.

The background BG of the image is printed in true grey, that is, with a proportion of black ink (K), such as 50/100, and without any of the primary color inks cyan, magenta and yellow.

It has been found that a grey background makes it easier for an observer to identify the transition element in the scale; this is believed to be due to the fact that the contrast of the scales against a white background is too high and may confuse the perception.

The color scales are contained in a color file, for example in TIF format, associated to the printing file; the color file may also have other suitable formats.

In embodiments of the invention, the printing file further comprises printer settings for those variables that can somehow modify the color performance of the device; this avoids the need to manually set the values as well as possible mistakes in the settings. The user cannot override the settings, because the printing file is such that it cannot be modified by the user.

In particular, the printing file may comprise settings for disabling any kind of color emulation, such as RGB emulation or CMYK emulation, and for avoiding a color rendering option that may modify the colors foreseen in the color scales.

What is claimed is:

1. A method for assessing color performance in a printing device provided with color printing means for printing at least three primary color inks, wherein said method comprises the steps of:

(a) providing a printing file for printing at least one color scale, said scale comprising:

a plurality of colored regions defined by substantially equal amounts of a first primary color ink and of a second primary color ink and a variable amount of a third primary color ink, said amount of third primary color ink increasing progressively from each region to the adjacent region in one direction of the scale, and a transition region defined by substantially equal amounts of the three primary color inks;

(b) printing said printing file with said printing device to obtain a printed color scale; and (c) visually analysing the printed color scale to assess the performance of said color printing means for printing said third primary color ink, on the basis of the position of the transition region along the color scale.

2. A method as claimed in claim 1, wherein said printing file contains an independent color scale for each of said primary color inks, and said step (c) comprises visually analysing the printed color scales to assess the performance of said color printing means for printing each of the three primary color inks, on the basis of the position of the transition region along each color scale.

3. A method as claimed in claim 1, wherein said scale has a number of regions between 5 and 20.

4. A method as claimed in claim 1, wherein a numerical scale is printed a long said color scale.

5. A method as claimed in claim 1, wherein said printing file further provides a dark region defined by large predetermined amounts of each of the three primary color inks, said dark region being arranged such that it is printed prior to said color scale.

6. A method as claimed in claim 1, wherein said printing file further provides a grey background defined by a predetermined amount of black ink, against which said color scale is printed.

7. A method as claimed in claim 1, where in said primary color inks comprise Cyan, Magenta and Yellow.

8. A method as claimed in claim 1, wherein said printing file includes a TIF image file with said color scale.

9. A method as claimed in claim 1, wherein said printing file further comprises predetermined settings for the printing device.

10. A method as claimed in claim 9, wherein said predetermined settings include disabling any ink emulation or color rendering that may alter the colors defined in the printing file.

11. A method as claimed in claim 1, wherein said printing file is included in the machine code of the printing device.

12. A method as claimed in claim 1, wherein said printing file is such that it cannot be modified by a user.

13. A method as claimed in claim 1, wherein said printing device is an inkjet printer, and said color printing means are inkjet printheads.

14. A method for assessing color performance in a printing device provided with color printing means for printing at least three primary color inks, wherein said method comprises the steps of:

(a) providing a printing file for printing at least three independent color scales, one associated to each primary color ink, each scale comprising:

a plurality of colored regions defined by a variable amount of one primary color ink associated to the scale, the amount of said one primary color ink increasing progressively from each region to the adjacent region in one direction of the scale, and equal amounts of two other primary color inks, and a transition region defined by substantially equal amounts of the three primary color inks;

(b) printing said printing file with said printing device to obtain the printed color scales; and (c) visually analysing each printed color scale to assess the performance of said color printing means for printing each primary color ink, on the basis of the position of the transition region along each color scale.

15. A method for color calibrating a printing device provided with color printing means for printing at least three primary color inks, wherein said method comprises the steps of:

(a) providing a printing file for printing at least one color scale, said scale comprising:

a plurality of colored regions defined by substantially equal amounts of a first primary color ink and of a second primary color ink and a variable amount of a third primary color ink, said amount of third primary color ink increasing progressively from each region to the adjacent region in one direction of the scale, and a transition region defined by substantially equal amounts of the three primary color inks;

(b) printing said printing file with said printing device to obtain a printed color scale; and (c) visually analysing the printed color scale to assess the performance of said color printing means for printing said third primary color ink, on the basis of the position of the transition region along the color scale; and (d) color calibrating said color printing means for printing said third primary color ink in the printing device, according to the performance assessment of step (c).

16. A method as claimed in claim 15, wherein said printing file contains an independent color scale for each of said primary color inks, said step (c) comprises visually analysing the printed color scales to assess the performance of said color printing means for printing each of the three primary color inks, on the basis of the position of the transition region along each color scale, and said step (d) comprises color calibrating said color printing means for printing each primary color ink in the printing device, according to the performance assessment of step (c).

17. A printing file containing at least one color scale, said scale comprising:

a plurality of colored regions defined by substantially equal amounts of a first primary color ink and of a second primary color ink, and a variable amount of a third primary color ink, said amount of third primary color ink increasing progressively from each region to the adjacent region in one direction of the scale, and a transition region defined by substantially equal amounts of the three primary color inks.

18. A printing file as claimed in claim 17, further comprising a grey background defined by a predetermined amount of black ink, against which said color scale is printed.

19. A printing file as claimed in claim 17, further comprising predetermined settings for a printing device.

20. An inkjet printer provided with printheads for at least three primary color inks and comprising a printing file as claimed in claim 17.

* * * * *